US005314777A

United States Patent [19]

Watanabe et al.

[11] Patent Number: 5,314,777

[45] Date of Patent: May 24, 1994

[54] NEGATIVELY CHARGEABLE TONER FOR DEVELOPING LATENT ELECTROSTATIC IMAGES

[75] Inventors: Kazuhito Watanabe, Numazu; Toshiki Nanya, Mishima; Yasuaki Iwamoto, Numazu, all of Japan

[73] Assignee: Ricoh Company, Ltd., Tokyo, Japan

[21] Appl. No.: 76,406

[22] Filed: Jun. 14, 1993

[30] Foreign Application Priority Data

Jun. 16, 1992 [JP] Japan ..... 4-181722

[51] Int. Cl.[5] ..... G03G 9/09; G03G 9/097

[52] U.S. Cl. ..... 430/106; 430/106.6; 430/110

[58] Field of Search ..... 430/106, 106.6, 110

[56] References Cited

U.S. PATENT DOCUMENTS 3,609,082 9/1971 Moriconi et al. ..... 430/110 X 5,168,028 12/1992 Nanya et al. ..... 430/110

FOREIGN PATENT DOCUMENTS 262170 12/1985 Japan ..... 430/110

*Primary Examiner*—Roland Martin

*Attorney, Agent, or Firm*—Cooper & Dunham

[57] ABSTRACT

A negatively chargeable toner for developing latent electrostatic images is composed of a coloring agent; releasing agent; a binder resin including a polyester and a styrene - acryl-based polymer component with a weight-average molecular weight of 50,000 to 150,000, a number-average molecular weight of 2,000 to 12,000, and a glass transition temperature of 55° to 70° C. at a mixing ratio by weight in the range of (95:5) to (50:50); and a charge controlling agent including at least one phthalic ester which is mixed with the styrene - acryl-based polymer component, and at least one fluorine-containing quaternary ammonium salt.

11 Claims, 1 Drawing Sheet

NEGATIVELY CHARGEABLE TONER FOR DEVELOPING LATENT ELECTROSTATIC IMAGES

BACKGROUND OF THE INVENTION

1. Field of the Invention

The present invention relates to a negatively chargeable toner for developing latent electrostatic images, and more particularly to a negatively chargeable toner for use in a one-component or two-component dry type developer which is utilized in the electrophotographic method, electrostatic recording method and electrostatic printing method.

2. Discussion of the Background

For developing latent electrostatic images to visible images with a developer, there are conventionally proposed two methods, that is, one using a two-component developer comprising a toner and a carrier, and the other using a one-component developer comprising a toner, as disclosed in Japanese Laid-Open Patent Application 61-147261.

According to the method using the two-component type developer, a carrier acquires a charge of one polarity and a toner acquires a charge of the opposite polarity by the friction therebetween while the carrier and the toner are mixed and stirred together. The toner is attracted to a latent electrostatic image charged to a polarity opposite to that of the toner and the latent electrostatic image can thus be developed with the toner. Development techniques are divided into several groups according to the kinds of toner and carrier, for example, the magnetic brush development using iron powder carrier, the cascade development using beads carrier, and the fur brush development.

The developing method using the one-component type developer includes the powder cloud development in which a toner is used in the form of a mist, namely, an extremely fine powder, the contact development (or touch-down development) by which toner particles are brought into direct contact with the surface of a latent-electrostatic-image-bearing member, and the induction development by which a magnetic electroconductive toner is brought into direct contact with the surface of a latent-electrostatic-image-bearing member.

The toner applicable to the above-mentioned various development processes comprises toner particles, each toner particle comprising a binder resin such as natural resin or synthetic resin, and a coloring agent such as carbon black dispersed in the binder resin. For instance, a toner can be prepared by dispersing a coloring agent in a binder resin such as polystyrene and pulverizing the above mixture until the particle diameter reaches about 1 to 30 μm. Further, a magnetic toner can be obtained by addition of a magnetic material such as magnetite to the aforementioned components.

The toner used in previously mentioned developing methods is designed to acquire a positive or negative polarity in accordance with the polarity of the latent electrostatic images to be developed. The toner can be charged to a desired polarity by the triboelectric charging of a resin component contained in the toner. When the toner is charged by the triboelectric charging, however, the charge quantity of toner is relatively small, so that the obtained images become vague due to the fogging. Therefore, a dye, pigment or charge controlling agent capable of imparting the charging characteristic to the obtained toner is conventionally contained in the toner to successfully achieve the triboelectric charging of the toner.

Examples of the conventional charge controlling agent capable of negatively charging the toner include a metal complex salt of a monoazo dye; nitrohumic acid and salts thereof; metal complexes, such as Co-, Cr- and Fe-complexes of salicylic acid, naphthoic acid and dicarboxylic acid; sulfonated copper phthalocyanine pigment; a nitro-group- or halogen-introduced styrene oligomer; chlorinated paraffin; and melamine resin. The structures of the above charge controlling agents are complicated and the characteristics thereof are unstable. In addition, they are apt to decompose in the course of kneading under application of heat thereto, and they are easily caused to deteriorate by the application of mechanical shock and friction thereto, or by the changes in temperature and humidity. As a result, the charge controlling properties of the above-mentioned conventional charge controlling agents are degraded. In addition, the charge-imparting capabilities change depending upon the environmental conditions in most of the above conventional charge controlling agents. When the toner comprising the above-mentioned charge controlling agent is used in an electrophotographic image forming apparatus over a long period of time, there occurs the problem of toner-filming, which is associated with defective charging.

Recently, a binder resin comprising polyester resin or epoxy resin is widely used in the toner. This is because the above-mentioned binder resin has the advantages that the binder resin can be prevented from fusing and adhering to a vinyl chloride sheet, the original color of a coloring agent contained in the toner is not impaired, and both the storage stability and the image-fixing property at low temperature can be satisfied at the same time.

However, when the binder resin comprising polyester resin or epoxy resin is contained in the toner, the charge quantity of toner is insufficient at the initial stage, or decreased during repeated operations even though the initial charge quantity of toner is sufficient. Consequently, the fogging and the scattering of toner particles easily take place in the practical use. The above-mentioned defects are ascribed to the chemical structures of the polyester resin and the epoxy resin. More specifically, it is supposed that functional groups such as —COOH group and —OH group remain in the polyester resin and the epoxy resin, which hinder the maintenance of charging characteristics of the toner in a stable condition.

Further, the binder resin comprising polyester resin is superior in the image-fixing property at low temperature, although the grindability is poor in the preparation of the toner. A binder resin comprising a styrene-acryl-based resin is not satisfactory when used in the toner from the viewpoint of the image-fixing property at low temperature.

A binder resin for use in the toner disclosed in Japanese Laid-Open Patent Application 2-127657 comprises polyester resin, and other resins with a number-average molecular weight of 11,000 or less, such as styrene and a styrene-acryl-based resin. In this case, to improve the grindability of the polyester resin, the resins such as styrene and styrene-acryl-based resin are added to the polyester resin in an amount of up to 30 wt. % of the total weight of the binder resin. However, when the binder resin comprises the polyester resin and the styrene-acryl-based resin with a low molecular weight, the binder resin is apt to fuse and adhere to a vinyl chloride sheet, so that the vinyl chloride sheet is easily stained with the binder resin of the toner when brought into contact with an image-receiving medium carring the toner images thereon.

SUMMARY OF THE INVENTION

Accordingly, a first object of the present invention is to provide a negatively chargeable toner for developing latent electrostatic images, with good grindability in the preparation thereof, which is capable of achieving image fixation at low temperature, free from the hot off-set phenomenon and the problem of a resin component contained in the toner fusing and adhering to a vinyl chloride sheet.

A second object of the present invention is to provide a negatively chargeable toner capable of achieving stable triboelectric charging in toner particles, and between toner particles and carrier particles, and between toner particles and charge-imparting members such as a development sleeve and a blade particularly in the case where the toner is used as a one-component type developer, with the distribution of the triboelectric charging being sharp and uniform, the charging characteristics of the toner being quickly rising up and maintained with environmental stability, and the charge quantity of toner being appropriately controlled in accordance with a development system to be employed.

A third object of the present invention is to provide a negatively chargeable toner capable of producing high quality images without the toner deposition of background, the scattering of toner particles, the edge effect, and other defects caused by the accumulation of electric charge in development.

The above-mentioned objects of the present invention can be achieved by a negatively chargeable toner for developing latent electrostatic images comprising a coloring agent; a releasing agent; a binder resin comprising a polyester and a styrene-acryl-based polymer component with a weight-average molecular weight of 50,000 to 150,000, a number-average molecular weight of 2,000 to 12,000, and a glass transition temperature of 55° to 70° C. at a mixing ratio by weight in the range of (95:5) to (50:50); and a charge controlling agent comprising at least one phthalic ester of general formula (I) which is mixed with the styrene-acryl-based polymer component:

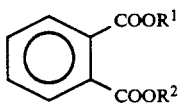

wherein $R^1$ and $R^2$ each represent a saturated or unsaturated hydrocarbon group having 1 to 20 carbon atoms, a phenyl group, or a phenyl-group-containing saturated or unsaturated hydrocarbon group having 1 to 20 carbon atoms, and at least one fluorine-containing quaternary ammonium salt of general formula (II):

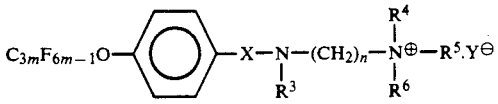

wherein X represents $—SO_2—$ or —CO—; $R^3$, $R^4$, $R^5$ and $R^6$ each represent hydrogen, an alkyl group having 1 to 10 carbon atoms, or an aryl group; Y represents iodine or bromine; and m and n are integers of 1 to 20.

BRIEF DESCRIPTION OF THE DRAWING

A more complete appreciation of the present invention and many of the attendant advantages thereof will be readily obtained as the same becomes better understood by reference to the following detailed description when considered in connection with the accompanying drawing, wherein.

DESCRIPTION OF THE PREFERRED EMBODIMENTS

Figure 1:
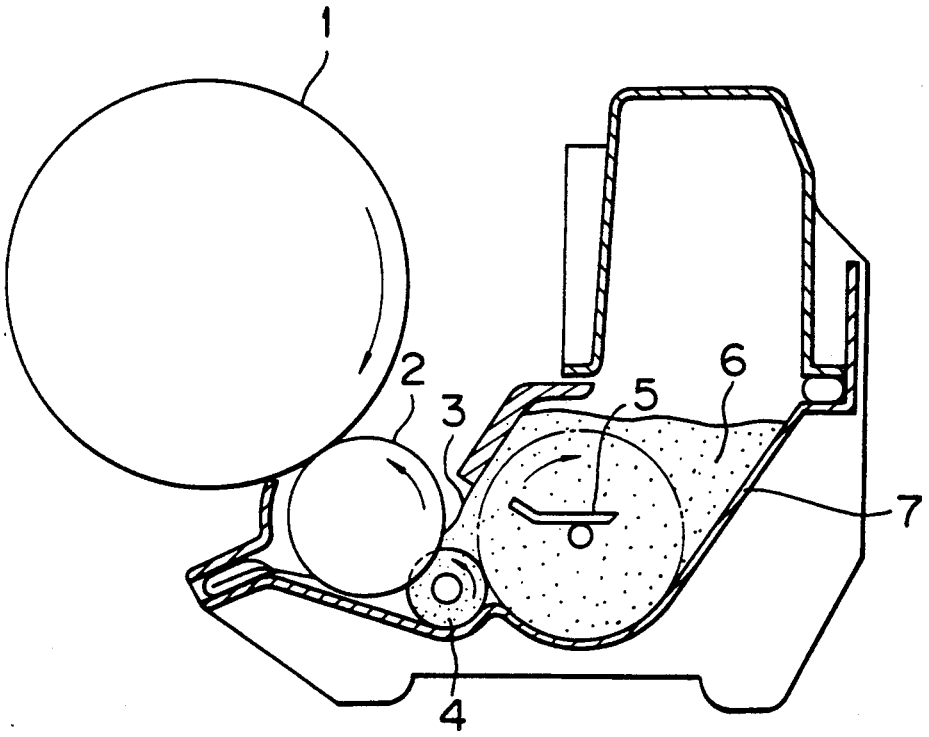
FIG. 1 is a schematic cross-sectional view of a development unit in which a toner of the present invention is used to produce toner images.

The binder resin for use in a negatively chargeable toner according to the present invention comprises a polyester, and a styrene-acryl-based polymer component at the mixing ratio by weight of (95:5) to (50:50). When the styrene-acryl-based polymer component is contained in an amount of less than 5 wt. % of the total weight of the binder resin, the grindability cannot be improved in the preparation of the toner. When the amount of the styrene-acryl-based polymer component is more than 50 wt. % of the total weight of the binder resin, on the other hand, the obtained toner is not satisfactory with respect to the image-fixing performance at low temperature, the heat-resistant preservability, and the resistance to hot off-set phenomenon.

As the styrene-acryl based polymer component for use in the present invention, a mixture of a styrene homopolymer and an acryl-based homopolymer, or a styrene-acryl-based copolymer can be employed alone or in combination.

Examples of the monomer for the styrene-acryl-based polymer component include a styrene and substituted monomers thereof, acrylic acid and esters thereof, methacrylic acid and esters thereof, and acrylonitrile The weight-average molecular weight of the styrene-acryl-based polymer component for use in the binder resin of the toner is in the range of 50,000 to 150,000, and preferably in the range of 70,000 to 120,000.

In addition, the number-average molecular weight of the styrene-acryl-based polymer component is in the range of 2,000 to 12,000, and preferably in the range of 3,000 to 7,000.

When the weight-average molecular weight and the number-average molecular weight of the styrene-acryl-based polymer component are within the respective ranges previously mentioned, the grindability, the image-fixing performance at low temperature, the resistant to hot off-set phenomenon, and the heat-resistant preservability of the toner are excellent. While the styrene-acryl-based polymer component with a number-average molecular weight of more than 12,000 has no effect on the improvement of the grindability in preparation of the toner, the styrene-acryl-based polymer component with a number-average molecular weight of less than 2,000 is disadvantageous because of the decrease in the resistance to hot off-set phenomenon.

The glass transition temperature (Tg) of the styrene-acryl-based polymer component for use in the present invention is in the range of 55° to 70° C. When the glass transition temperature of the above polymer component is lower than 55° C, the heat-resistant preservability and the resistance to hot-off set phenomenon deteriorate.

On the other hand, when the glass transition temperature thereof is higher than 70° C., the image-fixing performance at low temperature cannot be achieved, and the grindability cannot be improved.

The styrene-acryl-based polymer component for use in the binder resin comprises a charge controlling agent which comprises at least one phthalic ester of general formula (I).

It is preferable that the amount of the phthalic ester of general formula (I) be in the range of 0.1 to 20 wt. % of the total weight of the styrene-acryl-based polymer component.

When the amount of the phthalic ester of general formula (I) contained in the styrene-acryl-based polymer component is within the above range, the adhesion of the fused toner to a vinyl chloride sheet can be prevented. At the same time, the heat-resistant preservability can be improved, and the occurrence of the hot off-set phenomenon can be avoided.

Examples of the phthalic ester of general formula (I) serving as a charge controlling agent are dimethyl phthalate, diethyl phthalate, dibutyl phthalate, diheptyl phthalate, di-n-octyl phthalate, diisononyl phthalate, octyldecyl phthalate, diisodecyl phthalate, butylbenzyl phthalate and dicyclohexyl phthalate. The phthalic ester for use in the present invention is not limited to the above-mentioned examples.

Furthermore, the toner according to the present invention comprises at least one fluorine-containing quaternary ammonium salt of formula (II) as a charge controlling agent.

It is preferable that the amount of the fluorine-containing quaternary ammonium salt be in the range of 0.1 to 10 wt. % of the total weight of the toner.

When the amount of the fluorine-containing quaternary ammonium salt is within the above range, the toner can readily be provided with the desired charge quantity. In addition, when the toner of the present invention is used for a two-component type developer, the electrostatic attraction between toner particles and carrier particles is adequate, so that the decrease in fluidity of the developer can be prevented and the decrease in image density of the obtained images can be avoided.

Examples of the fluorine-containing quarternary ammonium salt of general formula (II) are as follows:

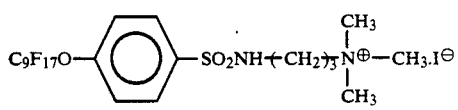
II-1

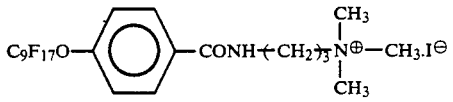
II-2

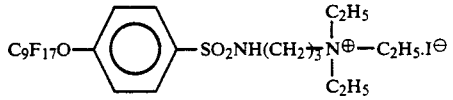
II-3

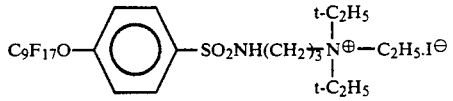
II-4

-continued

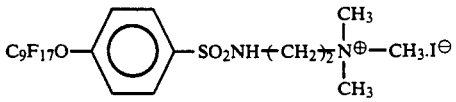
II-5

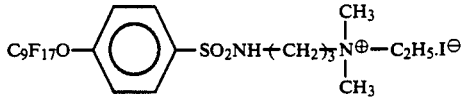
II-6

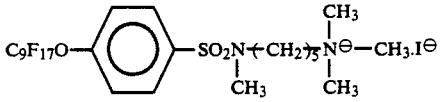
II-7

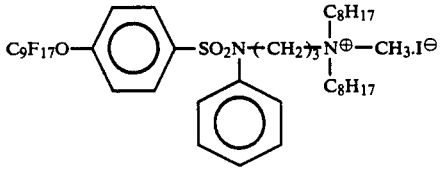
II-8

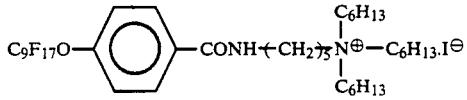
II-9

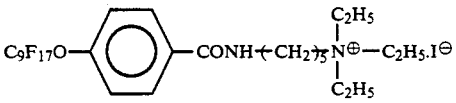
II-10

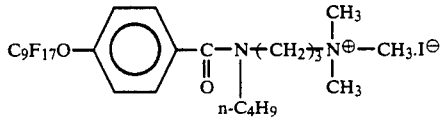
II-11

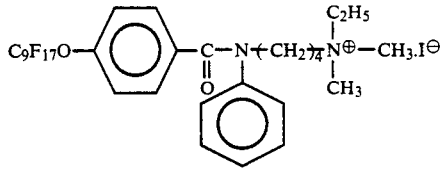
II-12

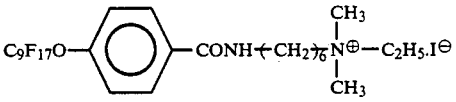
II-13

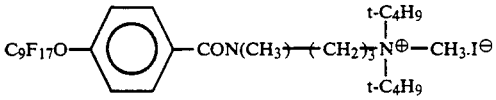
II-14

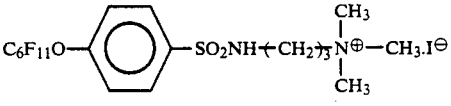
II-15

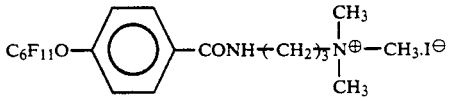
II-16

-continued
II-17
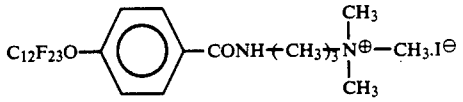
II-18
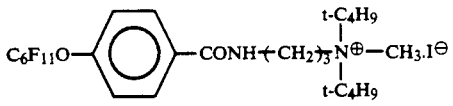
II-19
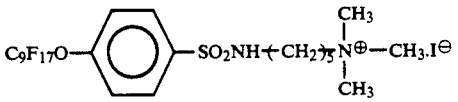
II-20
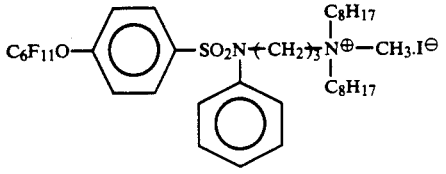
II-21
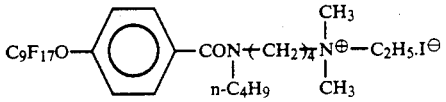
II-22
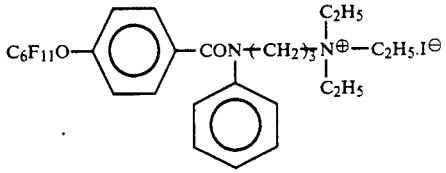
II-23
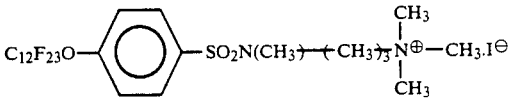
II-24
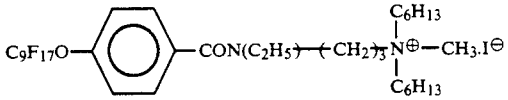
II-25
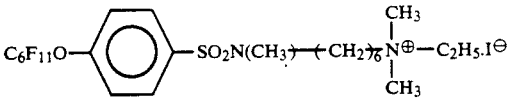
II-26
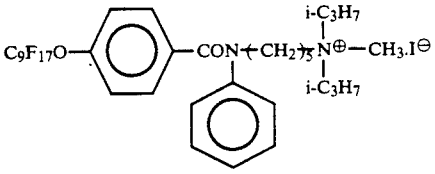
II-27
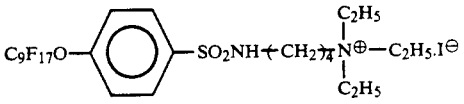
II-28
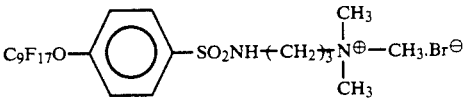
-continued
II-29
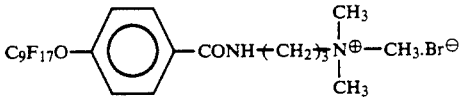
II-30
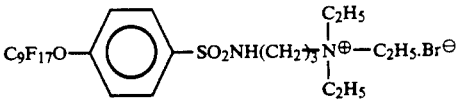
II-31
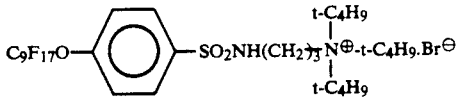
II-32
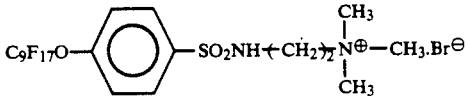
II-33
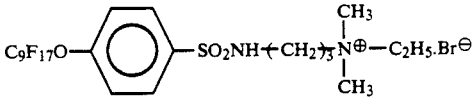
II-34
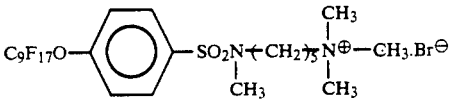
II-35
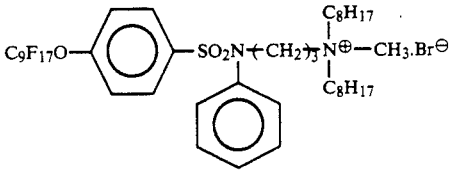
II-36
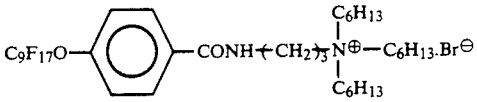
II-37
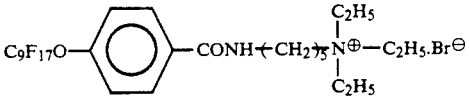
II-38
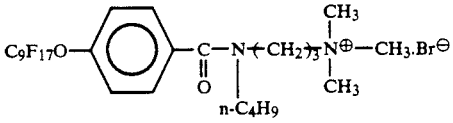
II-39
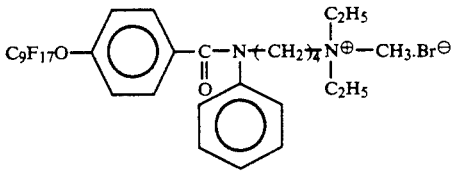
II-40
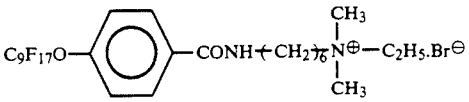

-continued

II-41

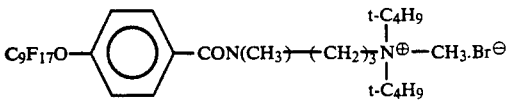

II-42

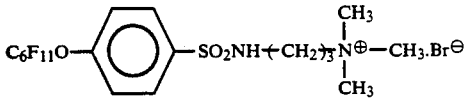

II-43

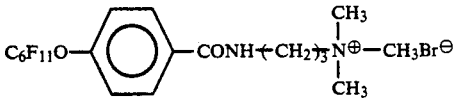

II-44

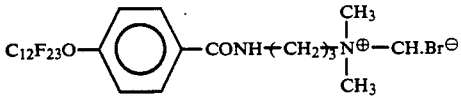

II-45

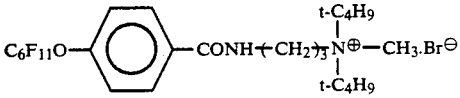

II-46

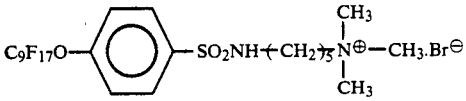

II-47

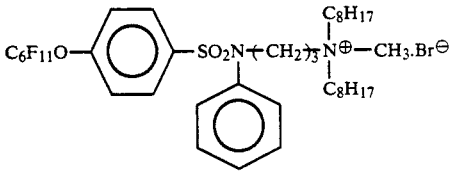

II-48

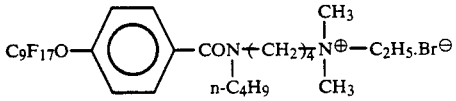

II-49

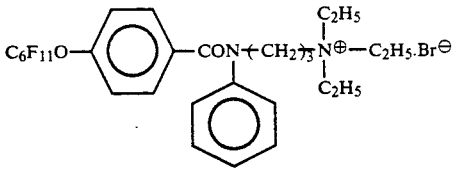

II-50

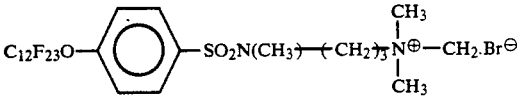

II-51

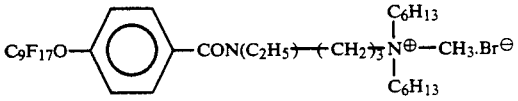

II-52

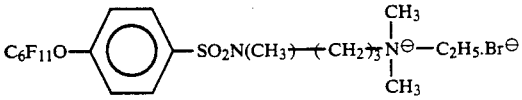

-continued

II-53

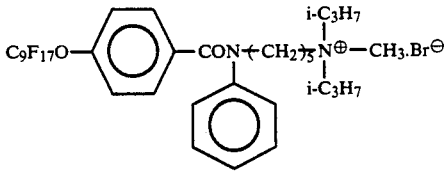

II-54

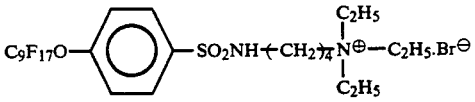

It is advantageous that the polyester resin for use in the binder resin be prepared by polycondensation of an alcohol and a carboxylic acid.

Examples of the alcohol used for the preparation of the polyester resin are diols such as polyethylene glycol, diethylene glycol, triethylene glycol, 1,2-propylene glycol, 1,3-propylene glycol, 1,4-propylene glycol, neopentyl glycol and 1,4-butenediol; etherified bisphenols such as 1,4-bis(hydroxymethyl)cyclohexane, bisphenol A, hydrogenated bisphenol A, a reaction product of polyoxyethylene and bisphenol A and a reaction product of polyoxypropylene and bisphenol A; dihydric alcohol monomers of the above diols and etherified bisphenols with a substituent of a saturated or unsaturated hydrocarbon group having 3 to 22 carbon atoms; other dihydric alcohol monomers; and alcohol monomers with three or more hydroxyl groups such as sorbitol, 1,2,3,6-hexanetetrol, 1,4-sorbitan, pentaerythritol, dipentaerythritol, tripentaerythritol, sucrose, 1,2,4-butanetriol 1,2,5-pentanetriol glycerol, 2-methylpropanetriol, 2-methyl-1,2,4-butanetriol, trimethylolethane, trimethylolpropane and 1,3,5-trihydroxymethylbenzene.

Examples of the carboxylic acid used for the preparation of the polyester resin are monocarboxylic acids such as palmitic acid, stearic acid and oleic acid; dicarboxylic acids such as maleic acid, fumaric acid, mesaconic acid, citraconic acid, itaconic acid, glutaconic acid, phthalic acid, isophthalic acid, terephthalic acid, cyclohexanedicarboxylic acid, succinic acid, adipic acid, sebacic acid, and malonic acid; the above dicarboxylic acids with a substituent of a saturated or unsaturated hydrocarbon group having 3 to 22 carbon atoms; anhydrides of the above dicarboxylic acids; dimers of a lower alkyl ester and linolenic acid; other dicarboxylic acids; carboxylic acids with three or more carboxyl groups such as 1,2,4-benzenetricarboxylic acid, 1,2,5-benzenetricarboxylic acid, 1,2,4-cyclohexanetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl)methane and 1,2,7,8-octanetetracarboxylic acid; and anhydrides of the above carboxylic acids with three or more carboxyl group.

In the present invention, the charge controlling agent may further comprise a metal-containing azo dye as an auxiliary charge controlling agent, in combination with the previously mentioned phthalic ester of general formula (I) and fluorine-containing quaternary ammonium salt of general formula (II). Any commercially available metal-containing azo dyes can be employed in the present invention. For example, "Aizen Spilon Black TRH", "Aizen Color T-37", "Aizen Color T-77", and "Aizen Color T-95" (Trademark), made by Hodogaya Chemical Co., Ltd.; and "Bontron S-32", "Bontron S-34", "Bontron S-40", and "Bontron S-44" (Trademark), made by Orient Chemical Industries Ltd., are preferably employed.

Moreover, the negatively chargeable toner of the present invention comprises a releasing agent. The releasing agent can be employed in combination with the above-mentioned auxiliary charge controlling agent.

Examples of the releasing agent are a carnauba wax, a montan wax, an oxidized rice wax and a sazohl wax. These waxes can be employed alone or in combination.

The carnauba wax which is obtained in the form of crystallites, free of a free aliphatic acid, is suitable for the releasing agent for use in the toner of the present invention. It is preferable that the acid value of the carnauba wax be 5 or less, and the average particle diameter thereof be 1 μm or less when dispersed in the binder resin.

For the montan wax, a conventional montan ester wax obtained from a mineral by purification is preferably employed as the releasing agent in the toner of the present invention. It is preferable that the montan wax be in the form of crystallites, and that the acid value thereof be in the range of 5 to 14.

The previously mentioned oxidized rice wax for use in the releasing agent can be obtained by oxidizing a rice bran wax in the air. It is preferable that the acid value of the oxidized rice wax be in the range of 10 to 30.

When the acid value of each wax is within the above range, the image-fixing at low temperature can be achieved.

It is preferable that the total amount of the above-mentioned waxes serving as the releasing agents be in the range of 1 to 15 parts by weight, more preferably in the range of 3 to 10 parts by weight, to 100 parts by weight of the polyester resin for use in the binder resin. When the total amount of the waxes serving as the releasing agents is within the above range, the desired releasing effect can be obtained without the spent phenomenon of the toner to the carrier.

Examples of the coloring agent for use in the toner of the present invention are carbon black, lamp black, black iron, ultramarine blue, nigrosine dye, aniline blue, phthalocyanine blue, phthalocyanine green, Hansa Yellow G, Rhodamine 6G lake, Calconyl Blue, chrome yellow, quinacridone, Benzidine Yellow, Rose Bengale, triallymethane dyes, monoazo dyes and pigments, and disazo dyes and pigments. The above-mentioned conventional dyes and pigments can be employed alone or in combination.

In addition, the negatively chargeable toner according to the present invention can be used as a magnetic toner by adding a magnetic material thereto.

Examples of the magnetic material for preparation of the magnetic toner are iron oxides such as magnetite, hematite and ferrite; metals such as iron, cobalt and nickel; alloys of the above-mentioned magnetic metals and the following metals such as aluminum, copper, lead, magnesium, tin, zinc, antimony, beryllium, bismuth, cadmium, calcium, manganese, selenium, titanium, tungsten and vanadium; and mixtures thereof.

It is preferable that the average particle diameter of the above-mentioned magnetic material be in the range of about 0.1 to 2 μm.

The amount of the magnetic material is preferably in the range of about 20 to 200 parts by weight, and more preferably in the range of 40 to 150 parts by weight, to 100 parts by weight of the binder resin contained in the toner according to the present invention.

In addition, the toner according to the present invention may further comprise other additives when necessary.

Examples of the additives are lubricants such as Teflon and zinc stearate; abrasives such as cerium oxide and silicon carbide; fluidity-providing agents or caking inhibitors such as colloidal silica and aluminum oxide; electroconductivity-imparting agents such as carbon black and tin oxide; and a fixing-promoting agent such as a low-molecular weight polyolefin.

The toner according to the present invention can be used for a two-component type developer in combination with a carrier.

Any conventional carrier particles are available for the two-component developer. For example, non-coated core carrier particles such as magnetic finely-divided particles including iron powder, ferrite powder and nickel powder, and glass beads; and resin-coated carrier particles such as silicone-resin-coated carrier particles are employed.

It is preferable that the average particle diameter of the core carrier particles be in the range of 10 to 1,000 μm, more preferably in the range of 30 to 500 μm.

In the preparation of the silicone-resin-coated carrier particles, it is preferable that the amount of the silicone resin be in the range of 1 to 10 wt. % of the total weight of the core carrier particle. In order to form a silicone resin layer on the core carrier particle, the silicone resin may be coated on the surface of the core carrier particle by the conventional spraying or dipping method.

Any conventionally known silicone resins can be employed for the silicone resin layer in the resin-coated carrier particles. For example, commercially available products such as "KR261", "KR271", "KR272", "KR275", "KR280", "KR282", "KR285", "KR251", "KR155", "KR220", "KR201", "KR204", "KR205", "KR206", "SA-4", "ES1001", "ES1001N", "ES1002T", and "KR3093" (Trademark), made by Shin-Etsu Chemical Co., Ltd.; and "SR2100", "SR2101", "SR2107", "SR2110", "SR2108", "SR2109", "SR2115", "SR2400", "SR2410", "SR2411", "SH805", "SH806A", and "SH840" (Trademark), made by Toray Silicone Co., Ltd., are preferably employed.

The coating liquid for the silicone resin layer for use in the resin-coated carrier particles can be prepared by adding electroconductive finely-divided particles and a silane coupling agent to a silicone resin solution, followed by mixing and dispersing with an appropriate mixer.

The amount of the electroconductive finely-divided particles is preferably in the range of 0.01 to 30 parts by weight, more preferably in the range of 0.1 to 20 parts by weight, to 100 parts by weight of the silicone resin. The conventionally known carbon black such as contact black, furnace black, and thermal black can be employed as the electroconductive finely-divided particles.

It is preferable that the particle diameter of the electroconductive finely-divided particles dispersed in the obtained silicone resin layer be in the range of about 0.01 to 5.0 μm.

The silane coupling agent for use in the silicone resin layer of the resin-coated carrier particle is a compound represented by the formula of $X\text{-}Si(OR)_3$, wherein x represents a functional group which reacts with an organic material, and R represents a hydrolyzable group. In particular, an amino silane coupling agent containing an amino group is preferably employed for the preparation of the silicone resin layer.

When the amino silane coupling agent is used for the preparation of the silicone resin layer, it is preferable that the amount of the amino silane coupling agent be in the range of 0.1 to 10 parts by weight, more preferably in the range of 0.2 to 5 parts by weight, to 100 parts by weight of the silicone resin.

Examples of the amino silane coupling agent are γ-(2-aminoethyl)aminopropyl trimethoxysilane, γ-(2-aminoethyl)aminopropyl methyldimethoxysilane, γ-anilinopropyl trimethoxysilane, and octadecyldimethyl[3-(trimethoxysilyl)propyl]ammonium chloride.

Other features of this invention will become apparent in the course of the following description of exemplary embodiments, which are given for illustration of the invention and are not intended to be limiting thereof.

PREPARATION EXAMPLE 1-1

Preparation of Styrene-Acryl-based Polymer Component A 40 parts by weight of methyl isobutyl ketone were placed in a flask with a stirrer, and heated to 90° C. with stirring in a stream of nitrogen gas. A mixture of 100 parts by weight of styrene and 25 parts by weight of benzoyl peroxide was added dropwise over a period of 6 hours to the methyl isobutyl ketone which was maintained at 90° C. Subsequently, the above-mentioned reaction mixture was subjected to polymerization at 90° C. for 10 hours, whereby a styrene polymer solution was obtained.

The procedure for preparation of the above obtained styrene polymer solution was repeated except that the styrene was replaced by butyl acrylate, whereby a butyl acrylate polymer solution was obtained.

Furthermore, 5 parts by weight of the thus obtained butyl acrylate polymer solution and 5 parts by weight of diisononyl phthalate were added to 95 parts by weight of the above prepared styrene polymer solution. The thus obtained reaction mixture was dried under vacuum, so that styrene-acryl-based polymer component A (Mw=94,000, Mn=5,100, and Tg=63° C.) containing a phthalic ester was obtained in the form of a solid.

PREPARATION EXAMPLE 1-2

Preparation of Styrene-Acryl-based Polymer Component B

The procedure for preparation of the styrene-acryl-based polymer component A in Preparation Example 1-1 was repeated except that the amount of the diisononyl phthalate was changed from 5 parts by weight to 10 parts by weight, so that a styrene-acryl-based polymer component B (Mw=92,000, Mn=5,000, and Tg=66° C.) containing a phthalic ester was obtained in the form of a solid.

PREPARATION EXAMPLE 1-3

Preparation of Styrene-Acryl-based Polymer Component C 40 parts by weight of methyl isobutyl ketone were put into a flask with a stirrer, and heated to 90° C. with stirring in a stream of nitrogen gas. A mixture of 95 parts by weight of styrene, 10 parts by weight of butyl acrylate and 25 parts by weight of benzoyl peroxide was added dropwise over a period of 6 hours to the methyl isobutyl ketone which was maintained at 90° C. Subsequently, the above-mentioned mixture was subjected to polymerization at 90° C. for 10 hours, whereby a styrene-butyl acrylate copolymer solution was obtained.

With the addition of 2 parts by weight of dioctyl phthalate, the styrene-butyl acrylate copolymer solution was dried under vacuum, so that a styrene-acryl-based polymer component C containing a phthalic ester (Mw=100,000, Mn=5,500, and Tg=65° C.) was obtained in the form of a solid.

PREPARATION EXAMPLE 1-4

Preparation of Styrene-Acryl-based Polymer Component D

The procedure for preparation of the styrene-acryl-based polymer component A in Preparation Example 1-1 was repeated except that the butyl acrylate was replaced by methacrylate, and 5 parts by weight of diisononyl phthalate employed in Preparation Example 1-1 were replaced by 12 parts by weight of diisodecyl phthalate, so that a styrene-acryl-based polymer component D (Mw=91,000, Mn=4,300, and Tg=68° C.) containing a phthalic ester was obtained in the form of a solid.

PREPARATION EXAMPLE 1-5

Preparation of Styrene-Acryl-based Polymer Component E

The procedure for preparation of the styrene-acryl-based polymer component A in Preparation Example 1-1 was repeated except that the butyl acrylate was replaced by 2-ethylhexyl acrylate, and 5 parts by weight of diisononyl phthalate employed in Preparation Example 1-1 were replaced by 12 parts by weight of diisodecyl phthalate, so that a styrene-acryl-based polymer component E (Mw=93,000, Mn=4,800, and Tg=67° C.) containing a phthalic ester was obtained in the form of a solid.

COMPARATIVE PREPARATION EXAMPLE 1-1

Preparation of Comparative Styrene-Acryl-based Polymer Component F

The procedure for preparation of the styrene-acryl-based polymer component C in Preparation Example 1-3 was repeated except that a mixture of 95 parts by weight of styrene and 10 parts by weight of butyl acrylate for preparation of the styrene-butyl acrylate copolymer solution in Preparation Example 1-3 was replaced by a mixture of 80 parts by weight of styrene, 15 parts by weight of 2-ethylhexyl acrylate and 5 parts by weight of butyl acrylate to prepare a styrene-2-ethylhexyl acrylate-butyl acrylate copolymer solution, so that a comparative styrene-acryl-based polymer component F (Mw=350,000, Mn=20,000, and Tg=65° C.) containing a phthalic ester was obtained in the form of a solid.

PREPARATION EXAMPLE 2-1

Preparation of Polyester Resin A 70 parts by weight of polyoxypropylene(2,2)-2,2-bis(4-hydroxyphenyl)propane, 20 parts by weight of fumaric acid, 5 parts by weight of n-dodecenyl succinic anhydride, and one part by weight of hydroquinone were placed in a glass flask. The mixture was heated to 230° C., and stirred in a stream of nitrogen gas to carry out the reaction.

The acid value of the thus obtained reaction mixture was 1.5 when no water content generated by the reaction flowed from the reaction mixture.

Subsequently, with the addition of 5 parts by weight of trimellitic anhydride to the above reaction mixture, the reaction was further continued for about 8.5 hours. The reaction was completed when the acid value of the above reaction mixture was 4.0, whereby a polyester resin A with a ring and ball softening point of 118° C. was obtained.

PREPARATION EXAMPLE 2-2

Preparation of Polyester Resin B 70 parts by weight of polyoxypropylene(2,2)-2,2-bis(4-hydroxyphenyl)propane, 15 parts by weight of fumaric acid, and 5 parts by weight of isododecenyl succinic anhydride were placed in a glass flask. The mixture was heated to 220° C. to carry out the reaction.

With the addition of 10 parts by weight of trimellitic anhydride to the above reaction mixture, the reaction was further continued at 200° C. until the acid value of the reaction mixture came to 3.0, whereby a polyester resin B with a ring and ball softening point of 119° C. was obtained.

PREPARATION EXAMPLE 3-1

Carrier A

The following components were dispersed in a homomixer for 30 minutes, whereby a coating liquid for a silicone resin layer was prepared:

| | Parts by Weight |
|---|---|
| Silicone resin solution (Trademark: "KR250", made by Shin-Etsu Chemical Co., Ltd.) | 100 |
| Toluene | 100 |

The above-prepared coating liquid for the silicone resin layer and 1000 parts by weight of ferrite particles with an average particle diameter of about 100 μm were placed in a fluidized bed coating apparatus to form a silicone resin layer on the surfaces of the ferrite particles. Thus, a silicone-resin-coated carrier A was prepared.

PREPARATION EXAMPLES 3-2 to 3-7

Preparation of Carriers B to G

A silicone resin, electroconductive finely-divided particles and a silane coupling agent as shown in Table 1 were dispersed in a homomixer for 30 minutes with the addition of 100 parts by weight of toluene thereto, so that a coating liquid for a silicone resin layer was separately obtained.

Each coating liquid for the silicone resin layer and 1000 parts by weight of ferrite particles with an average particle diameter of about 70 μm were placed in a fluidized bed coating apparatus to form a silicone resin layer on the surfaces of ferrite particles. Thus, silicone resin-coated carriers B to G were prepared.

TABLE 1

| | Silicone Resin | | Electroconductive Finely-divided Particles | | Silane Coupling Agent | |
|---|---|---|---|---|---|---|
| | Kind | Amount* | Kind | Amount* | Kind | Amount* |
| Ex. 3-2 Carrier B | Silicone resin "KR206" (Trademark), made by Shin-Etsu Chemical Co., Ltd. | 100 | Carbon black "#44" (Trademark), made by Mitsubishi Chemical Industries, Ltd. | 3 | — | — |
| Ex. 3-3 Carrier C | Silicone resin "KR2400" (Trademark), made by Dow Corning Toray Silicone Co., Ltd. | 100 | Tin oxide "S-1" (Trademark), made by Mitsubishi Metal Corporation | 2 | — | — |
| Ex. 3-4 Carrier D | Silicone resin "SR2400" (Trademark), made by Dow Corning Toray Silicone Co., Ltd. | 100 | Carbon black "#44" (Trademark), made by Mitsubishi Chemical Industries, Ltd. | 1 | Methyltrimethoxy-silane "SZ6070" (Trademark), made by Dow Corning Toray Silicone Co., Ltd. | 0.5 |
| Ex. 3-5 Carrier E | Silicone resin "KR204" (Trademark), made by Shin-Etsu Chemical Co., Ltd. | 100 | Carbon black "BPL" (Trademark), made by Cabot Corporation | 1 | Methyltrimethoxy-silane "SZ6070" (Trademark), made by Dow Corning Toray Silicone Co., Ltd. | 0.5 |
| Ex. 3-6 Carrier F | Silicone resin "SR2400" (Trademark), made by Dow Corning Toray Silicone Co., Ltd. | 100 | Tin oxide "S-1" (Trademark), made by Mitsubishi Metal Corporation | 1 | Methyltrimethoxy-silane "SZ6070" (Trademark), made by Dow Corning Toray Silicone Co., Ltd. | 0.5 |
| Ex. 3-7 Carrier G | Silicone resin "SR2400" (Trademark), made by Dow Corning Toray Silicone | 100 | Carbon black "Ketjen black" (Trademark), made by Lion Akzo Company | 1.5 | γ-anilinopropyl-trimethoxysilane "SZ6083" (Trademark), made by Dow Corning | 0.3 |

TABLE 1-continued

| Silicone Resin | | Electroconductive Finely-divided Particles | | Silane Coupling Agent | |
|---|---|---|---|---|---|
| Kind | Amount* | Kind | Amount* | Kind | Amount* |
| Co., Ltd. | | Ltd. | | Toray Silicone Co., Ltd. | |

*The unit is on the basis of "parts by weight"

EXAMPLE 1

The following components were mixed and stirred in a Henschel mixer, and kneaded in a roll mill at 130° to 140° C. for about 30 minutes. The thus obtained mixture was cooled to room temperature, pulverized and classified, whereby a toner with a particle diameter of 5 to 20 μm according to the present invention was obtained:

| | Parts by Weight |
|---|---|
| Polyester resin (Trademark: "Lunapale 1447", made by Arakawa Chemical Industries, Ltd.) | 80 |
| Styrene - acryl-based polymer component A | 20 |
| Carbon black | 10 |
| Fluorine-containing quaternary ammonium salt No. II-1 | 3 |
| Candelilla wax No. 2 (made by Noda Wax Co., Ltd.) | 5 |

2.5 parts by weight of the above prepared toner and 97.5 parts by weight of iron carrier particles with a particle size of 100 to 250 meshes were mixed in a ball mill, whereby a two-component type developer was fabricated.

The thus fabricated developer was subjected to an image formation test using a commercially available electrophotographic copying machine "FT-7570" (Trademark), made by Ricoh Company, Ltd. The initial images obtained by the above test were clear. Even after 100,000 copies were made, the images were still excellent in quality.

The initial charge quantity of the toner measured by the blow-off method was −18.5 μC/g. After the making of 100,000 copies, the charge quantity of the toner was −17.8 μC/g, which was almost the same as the initial charge quantity of the toner.

In addition, when the images were produced under the circumstances of high temperature and humidity of 35° C. and 90% RH, and low temperature and humidity of 10° C. and 15% RH, the image quality of the obtained images did not deteriorate in both cases.

The toner filming was not observed on the photoconductor.

The grindability of the toner in the preparation thereof was evaluated in such a manner that the toner particles roughly pulverized to have a particle diameter of about 100 μm were put into a grinder to process them to have a desired particle diameter ranging from 5 to 25 μm. The grindability of the toner was expressed by the throughput of the toner particles per hour by the grinder. The grindability of the toner prepared in Example 1 was 4.3 kg/h.

Moreover, the lower limit temperature for image fixing of the toner was 125° C., and the hot off-set occurrence temperature was 240° C. or more.

An image-receiving sheet carrying toner images which occupy a large area of the sheet was overlaid on a commercially available vinyl chloride sheet in such a fashion that the toner-image-bearing surface of the image-receiving sheet was brought into contact with the vinyl chloride sheet, and clipped together. This laminated material was allowed to stand in a thermostatic chamber of 30° C. for 3 hours. The condition of toner particles transferred to the vinyl chloride sheet was visually inspected and evaluated in accordance with the following five ranks:

1: No toner particles were transferred to the vinyl chloride sheet.
2: The toner particles were scarcely transferred to the vinyl chloride sheet.
3: The toner particles were slightly transferred to the vinyl chloride sheet.
4: The toner particles were considerably transferred to the vinyl chloride sheet.
5: Almost all the toner particles were transferred to the vinyl chloride sheet.

The degree of staining of the vinyl chloride sheet with the toner according to the present in Example 1 was expressed by the rank 2.

EXAMPLE 2

The toner according to the present invention was prepared in the same manner as in Example 1.

The procedure for preparation of the two-component type developer in Example 1 was repeated except that the iron powder carrier employed in Example 1 was replaced by the carrier E prepared in Preparation Example 3-5, so that a two-component type developer was fabricated.

The thus fabricated developer was subjected to the same image formation test as in Example 1. The initial images obtained by the above test were clear. Even after 120,000 copies were made, the obtained images were still excellent in quality.

The initial charge quantity of the toner measured by the blow-off method was −20.2 μC/g. After the making of 100,000 copies, the charge quantity of the toner was −18.1 μC/g, which was almost the same as the initial charge quantity of the toner.

In addition, even when the images were produced on 150,000 sheets under the circumstances of high temperature and humidity of 35° C. and 90% RH, and low temperature and humidity of 10° C. and 15% RH, the image quality of the obtained images did not deteriorate in both cases.

The toner filming was not observed on the photoconductor.

EXAMPLE 3

The following components were mixed and stirred in a Henschel mixer, and kneaded in a roll mill at 130° to 140° C. for about 30 minutes, whereby a toner with a particle diameter of 5 to 25 μm according to the present invention was obtained:

| | Parts by Weight |
|---|---|
| Polyester resin A | 80 |
| Styrene - acryl-based polymer component B | 20 |
| Carbon black | 10 |
| Fluorine-containing quaternary ammonium salt No. II-1 | 2 |
| Metal-containing monoazo dye (Trademark: "Bontron S-34", made by Orient Chemical Industries, Ltd. | 1 |
| Polypropylene oxide (Trademark: "TS-200", made by Sanyo Chemical Industries, Ltd.) | 5 |

2.5 parts by weight of the above prepared toner and 97.5 parts by weight of the silicone-resin-coated carrier A were mixed in a ball mill, whereby a two-component type developer was fabricated.

The thus fabricated developer was subjected to the same image formation test as in Example 1. The initial images obtained by the above test were clear with sharpness. Even after 100,000 copies were made, the images were still excellent in quality.

The initial charge quantity of the toner measured by the blow-off method was −21.1 μC/g. After the making of 120,000 copies, the charge quantity of the toner was −20.3 μC/g, which was almost the same as the initial charge quantity of the toner.

In addition, when the images were produced under the circumstances of high temperature and humidity of 35° C. and 90% RH, and low temperature and humidity of 10° C. and 15% RH, the image quality of the obtained images did not deteriorate in both cases.

The toner filming was not observed on the photoconductor.

The grindability of the toner prepared in Example 3 was 4.2 kg/h. The lower limit temperature for image fixing was 128° C. and the hot off-set occurrence temperature was 240° C. or more. The degree of staining of the vinyl chloride sheet with the toner prepared in Example 3 was evaluated in the same manner as in Example 1. As a result, it was expressed by the rank 1 of the previously mentioned evaluation scale.

EXAMPLE 4

The following components were mixed and stirred in a Henschel mixer, and kneaded in a roll mill at 130° to 140° C. for about 30 minutes, whereby a toner with a particle diameter of 5 to 25 μm according to the present invention was obtained:

| | Parts by Weight |
|---|---|
| Polyester resin A | 80 |
| Styrene - acryl-based polymer component C | 20 |
| Carbon black | 10 |
| Fluorine-containing quaternary ammonium salt No. II-2 | 2 |
| Zinc salt of salicylic acid (Trademark: "Bontrol E-84", made by Orient Chemical Industries, Ltd.) | 1 |
| Polypropylene Bontron "Viscol 660P", made by Sanyo Chemical Industries, Ltd.) | 5 |

2.5 parts by weight of the above prepared toner and 97.5 parts by weight of the silicone-resin-coated carrier E were mixed in a ball mill, whereby a two-component type developer was fabricated.

The thus fabricated developer was subjected to the same image formation test as in Example 1. The initial images obtained by the above test were clear with sharpness. Even after 120,000 copies were made, the images were still excellent in quality.

The initial charge quantity of the toner measured by the blow-off method was −21.1 μC/g. After the making of 120,000 copies, the charge quantity of the toner was −20.3 μC/g, which was almost the same as the initial charge quantity of the toner.

In addition, when the images were produced under the circumstances of high temperature and humidity of 35° C. and 90% RH, and low temperature and humidity of 10° C. and 15% RH, the image quality of the obtained images did not deteriorate in both cases.

The toner filming was not observed on the photoconductor.

The grindability of the toner prepared in Example 4 was 4.1 kg/h. The lower limit temperature for image fixing was 127° C. and the hot off-set occurrence temperature was 240° C. or more. When the degree of staining of the vinyl chloride sheet with the toner prepared in Example 4 was evaluated in the same manner as in Example 1. As a result, it was expressed by the rank 1 of the previously mentioned evaluation scale.

COMPARATIVE EXAMPLE 1

The procedure for preparation of the toner according to the present invention in Example 1 was repeated except that the fluorine-containing quaternary ammonium salt No. II-1 employed in the formulation for the toner in Example 1 was replaced by zinc salt of salicylic acid "Bontron E-84" (Trademark), made by Orient Chemical Industries, Ltd., so that a comparative toner was fabricated.

2.5 parts by weight of the thus obtained comparative toner and 97.5 parts by weight of iron carrier particles with a particle size of 100 to 250 meshes were mixed in a ball mill, so that a comparative two-component type developer was fabricated.

The thus fabricated comparative developer was subjected to the same image formation test as in Example 1. The initial images obtained by the above test were sharp without fogging. However, after about 50,000 copies were made, the images became vague due to fogging, and the toner filming was observed on the surface of the photoconductor.

The initial charge quantity of the toner measured by the blow-off method was −15.5 μC/g. After the making of 50,000 copies, the charge quantity of the toner decreased to −9.8 μC/g.

In addition, when the images were produced under the circumstances of high temperature and humidity of 35° C. and 90% RH, the obtained images were vague with fogging, and the image density thereof was as low as 0.85.

The grindability of the comparative toner prepared in Comparative Example 1 was 4.4 kg/h. The lower limit temperature for image fixing was 127° C. and the hot off-set occurrence temperature was 240° C. or more. The degree of staining of the vinyl chloride sheet with the compartive toner prepared in Comparative Example 1 was evaluated in the same manner as in Example 1. As a result, it was expressed by the rank 1 of the previously mentioned evaluation scale.

COMPARATIVE EXAMPLE 2

The procedure for preparation of the toner according to the present invention in Example 1 was repeated except that the styrene-acryl-based polymer component A for use in the formulation for the toner in Example 1 was replaced by the comparative styrene-acryl-based polymer component F, so that a comparative toner was fabricated.

Using the thus obtained comparative toner, a comparative developer was prepared in the same manner as in Example 1.

The thus fabricated comparative developer was subjected to the same image formation test as in Example 1. The initial images obtained by the above test were clear. Even after about 100,000 copies were made, the obtained images were still excellent in quality.

The initial charge quantity of the toner measured by the blow-off method was −17.5 μC/g. After the making of 100,000 copies, the charge quantity of the toner was −16.3 μm, which was almost the same as the initial charge quantity of the toner.

In addition, when the images were produced on 100,000 sheets under the circumstances of high temperature and humidity of 35° C. and 90% RH, and low temperature and humidity of 10° C. and 15% RH, the image quality of the obtained images did not deteriorate in both cases.

The toner filming was not observed on the photoconductor.

The grindability of the comparative toner prepared in Comparative Example 2 was as low as 3.0 kg/h.

The lower limit temperature for image fixing was 129° C. and the hot off-set occurrence temperature was 240° C. or more. The degree of staining of the vinyl chloride sheet with the comparative toner prepared in Comparative Example 2 was evaluated in the same manner as in Example 1. As a result, it was expressed by the rank 1 of the previously mentioned evaluation scale.

EXAMPLE 5

The following components were mixed and stirred in a Henschel mixer, and kneaded in a roll mill at 130° to 140° C. for about 30 minutes. The thus obtained mixture was cooled to room temperature, pulverized and classified, so that a toner with a particle diameter of 5 to 20 μm according to the present invention was obtained:

| | Parts by Weight |
|---|---|
| Polyester resin A | 80 |
| Styrene - acryl-based polymer component D | 20 |
| Carbon black | 10 |
| Fluorine-containing quaternary ammonium salt No. II-2 | 3 |
| Oxidized rice wax (Trademark: "Popko-S-A-3", made by Noda Wax Co., Ltd.) | 5 |

100 parts by weight of the above prepared toner, 3 parts by weight of silicon carbide with a particle diameter of about 2 μm, and 0.1 parts by weight of hydrophobic colloidal silica were thoroughly mixed in a speed kneader, whereby a one-component type developer was fabricated.

The thus fabricated developer was placed in a development unit as shown in FIG. 1, and a continuous image formation test was carried out. The initial images obtained by the above test were clear. Even after 50,000 copies were continuously made, the images were still excellent in quality.

The development process in the image formation test using the development unit as shown in FIG. 1 will now be explained.

In the development unit as shown in the single figure, a toner 6 placed in a toner reservoir 7 is forcibly brought onto a sponge roller 4 by a stirring blade 5, so that the toner 6 is supplied onto the sponge roller 4. As the sponge roller 4 is rotated in the direction of the arrow, the toner 6 fed to the sponge roller 4 is transported onto a toner transportation member 2, where the toner 6 is frictioned, and electrostatially or physically arracted to the toner transportion member 2. As the toner transportion member 2 is rotated in the direction of the arrow, a uniformly thin layer of the toner 6 is formed on the toner transportion member 2 by an elastic blade 3, and at the same time, triboelectrically charged to a predetermined polarity.

The toner 6 is then transported onto the surface of a latent-electrostatic-image-bearing member 1 which is situated in contact with or adjacent to the toner transportion member 2, so that the latent electrostatic image is developed to a visible toner image.

For instance, −800 v dc is applied to the organic photoconductor, and then the photoconductor is exposed to light images to form latent electrostatic images thereon. The thus formed latent electrostatic images are developed into visible toner images by the reversal development with the above-mentioned toner.

The initial charge quantity (Q/M) of the toner prepared in Example 5 on the toner transportation member 2 as shown in the single figure, measured by use of a specific charge quantity measuring apparatus, was −9.5 μC/g, which was regarded as sufficiently high. In the above specific charge quantity measuring apparatus, the toner particles on the toner transportation member 2 were sucked by a Faraday cage, with a filter layer equipped at an outlet thereof, and trapped therein to measure the charge quantity of the toner. After making of 50,000 copies, the charge quantity of the toner was −8.7 μC/g, which was almost the same as the initial charge quantity of the toner.

In addition, when the images were produced under the circumstances of high humidity, and low humidity, the image quality of the obtained images did not deteriorate in both cases.

The toner filming was not observed on the photoconductor.

The grindability of the toner prepared in Example 5 was 4.2 kg/h. The lower limit temperature for image fixing was 125° C. and the hot off-set occurrence temperature was 240° C. or more. The degree of staining of the vinyl chloride sheet with the toner prepared in Example 5 was evaluated in the same manner as in Example 1. As a result, it was expressed by the rank 1 of the previously mentioned evaluation scale.

EXAMPLE 6

The following components were mixed and stirred in a Henschel mixer, and kneaded in a roll mill at 130° to 140° C. for about 30 minutes. The thus obtained mixture was cooled to room temperature, pulverized and classified, whereby a blue toner with a particle diameter of 5 to 25 μm according to the present invention was obtained:

| | Parts by Weight |
|---|---|
| Polyester resin B | 80 |
| Styrene - acryl-based polymer component E | 20 |
| C.I. Pigment Blue 15 | 5 |
| Fluorine-containing quaternary ammonium salt No. II-2 | 2 |
| Zinc salt of salicylic acid (Trademark: "Bontron E-84", made by Orient Chemical Industries, Ltd.) | 1 |
| Carnauba was free of free aliphatic acids (Trademark: "NX-A-03", made by Noda Wax Co., Ltd.) | 5 |

2.5 parts by weight of the above prepared toner and 97.5 parts by weight of the silicone-resin-coated carrier G were mixed in a ball mill, whereby a two-component type developer was fabricated.

The thus fabricated developer was subjected to the same image formation test as in Example 1. The initial blue images obtained by the above test were clear with high reliability. Even after 150,000 copies were made, the images were still excellent in quality.

The initial charge quantity of the toner measured by the blow-off method was −18.9 μC/g. After the making of 150,000 copies, the charge quantity of the toner was −18.2 μC/g, which was almost the same as the initial charge quantity of the toner.

In addition, when the images were produced under the circumstances of high temperature and humidity of 35° C. and 90% RH, and low temperature and humidity of 10° C. and 15% RH, the image quality of the obtained images did not deteriorate in both cases.

The toner filming was not observed on the photoconductor.

The grindability of the toner prepared in Example 6 was 4.5 kg/h. The lower limit temperature for image fixing was 122° C. and the hot off-set occurrence temperature was 240° C. or more. The degree of staining of the vinyl chloride sheet with the toner prepared in Example 6 was evaluated in the same manner as in Example 1. As a result, it was expressed by the rank 1 of the previously mentioned evaluation scale.

EXAMPLE 7

The toner according to the present invention was prepared in the same manner as in Example 1.

The procedure for preparation of the two-component type developer in Example 1 was repeated except that the iron powder carrier employed in Example 1 was replaced by the silicone-resin-coated carrier E, so that a two-component type developer was fabricated.

The thus fabricated developer was subjected to the same image formation test as in Example 1. The initial images obtained by the above test were clear. Even after 120,000 copies were made, the images were still excellent in quality.

The initial charge quantity of the toner measured by the blow-off method was −17.3 μC/g. After the making of 120,000 copies, the charge quantity of the toner was −16.1 μC/g, which was almost the same as the initial charge quantity of the toner.

In addition, even when the images were produced on 120,000 sheets under the circumstances of high temperature and humidity of 35° C. and 90% RH, and low temperature and humidity of 10° C. and 15% RH, the image quality of the obtained images did not deteriorate in both cases.

The toner filming was not observed on the photoconductor.

EXAMPLE 8

The following components were mixed and stirred in a Henschel mixer, and kneaded in a roll mill at 130° to 140° C. for about 30 minutes. The thus obtained mixture was cooled to room temperature, pulverized and classified, whereby a toner with a particle diameter of 5 to 20 μm according to the present invention was obtained:

| | Parts by Weight |
|---|---|
| Polyester resin A | 90 |
| Styrene - acryl-based polymer component C | 10 |
| Carbon black | 10 |
| Fluorine-containing quaternary ammonium salt No. II-3 | 2 |
| Polypropylene (Trademark: Viscol 660P", made by Sanyo Chemical Industries, Ltd.) | 5 |

2.5 parts by weight of the above prepared toner and 97.5 parts by weight of the silicone-resin-coated carrier C were mixed in a ball mill, whereby a two-component type developer was fabricated.

The thus fabricated developer was subjected to the same image formation test as in Example 1. The image quality obtained by the image formation test, and the charge quantity of the toner are shown in Table 2.

Moreover, the grindability, the lower limit temperature for image fixing, the hot off-set occurrence temperature, and the degree of staining of a vinyl chloride sheet with the toner are shown in Table 3.

EXAMPLE 9

The following components were mixed and stirred in a Henschel mixer, and kneaded in a roll mill at 130° to 140° C. for about 30 minutes. The thus obtained mixture was cooled to room temperature, pulverized and classified, whereby a toner with a particle diameter of 5 to 20 μm according to the present invention was obtained:

| | Parts by Weight |
|---|---|
| Polyester resin A | 60 |
| Styrene - acryl-based polymer component C | 40 |
| Carbon black | 10 |
| Fluorine-containing quaternary ammonium salt No. II-3 | 2 |
| Sazohl wax | 5 |

2.5 parts by weight of the above prepared toner and 97.5 parts by weight of the silicone-resin-coated carrier A were mixed in a ball mill, so that a two-component type developer was fabricated.

The thus fabricated developer was subjected to the same image formation test as in Example 1. The image quality obtained by the image formation test, and the charge quantity of the toner are shown in Table 2.

Moreover, the grindability, the lower limit temperature for image fixing, the hot off-set occurrence temperature, and the degree of staining of a vinyl chloride sheet with the toner are shown in Table 3.

EXAMPLE 10

The following components were mixed and stirred in a Henschel mixer, and kneaded in a roll mill at 130° to 140° C. for about 30 minutes. The thus obtained mixture was cooled to room temperature, pulverized and classified, whereby a toner with a particle diameter of 5 to 20 μm according to the present invention was obtained:

| | Parts by Weight |
|---|---|
| Polyester resin A | 80 |
| Styrene - acryl-based polymer component D | 20 |
| Carbon black | 10 |
| Fluorine-containing quaternary ammonium salt No. II-2 | |
| Polypropylene (Trademark: "Viscol 550P", made by Sanyo Chemical Industries Co., Ltd.) | 5 |

2.5 parts by weight of the above prepared toner and 97.5 parts by weight of the silicone-resin-coated carrier G were mixed in a ball mill, whereby a two-component type developer was fabricated.

The thus fabricated developer was subjected to the same image formation test as in Example 1. The image quality obtained by the image formation test, and the charge quantity of the toner are shown in Table 2.

Moreover, the grindability, the lower limit temperature for image fixing, the hot off-set occurrence temperature, and the degree of staining of a vinyl chloride sheet with the toner are shown in Table 3.

EXAMPLE 11

The following components were mixed and stirred in a Henschel mixer, and kneaded in a roll mill at 130° to 140° C. for about 30 minutes. The thus obtained mixture was cooled to room temperature, pulverized and classified, whereby a toner with a particle diameter of 5 to 20 μm according to the present invention was obtained:

| | Parts by Weight |
|---|---|
| Polyester resin A | 80 |
| Styrene - acryl-based polymer component B | 20 |
| Carbon black | 10 |
| Fluorine-containing quaternary ammonium salt No. II-1 | 0.5 |
| Metal-containing monoazo dye (Trademark: "Bontron S-34", made by Orient Chemical Industries, Ltd.) | 2 |
| Polypropylene oxide (Trademark: "TS-200", made by Sanyo Chemical Industreis, Ltd.) | 5 |

2.5 parts by weight of the above prepared toner and 97.5 parts by weight of the silicone-resin-coated carrier C were mixed in a ball mill, whereby a two-component type developer was fabricated.

The thus fabricated developer was subjected to the same image formation test as in Example 1. The image quality obtained by the image formation test, and the charge quantity of the toner are shown in Table 2.

Moreover, the grindability, the lower limit temperature for image fixing, the hot off-set occurrence temperature, and the degree of staining of a vinyl chloride sheet with the toner are shown in Table 3.

EXAMPLE 12

The following components were mixed and stirred in a Henschel mixer, and kneaded in a roll mill at 130° to 140° C. for about 30 minutes. The thus obtained mixture was cooled to room temperature, pulverized and classified, whereby a toner with a particle diameter of 5 to 20 μm according to the present invention was obtained:

| | Parts by Weight |
|---|---|
| Polyester resin A | 80 |
| Styrene - acryl-based polymer component B | 20 |
| Carbon black | 10 |
| Fluorine-containing quaternary ammonium salt No. II-2 | 2 |
| Zinc salt of salicylic acid (Trademark: "Bontron E-84", made by Orient Chemical Industries, Ltd.) | 1 |
| Sazohl wax | 5 |

2.5 parts by weight of the above prepared toner and 97.5 parts by weight of the silicone-resin-coated carrier B were mixed in a ball mill, whereby a two-component type developer was fabricated.

The thus fabricated developer was subjected to the same image formation test as in Example 1. The image quality obtained by the image formation test, and the charge quantity of the toner are shown in Table 2.

Moreover, the grindability, the lower limit temperature for image fixing, the hot off-set occurrence temperature, and the degree of staining of a vinyl chloride sheet with the toner are shown in Table 3.

EXAMPLE 13

The following components were mixed and stirred in a Henschel mixer, and kneaded in a roll mill at 130° to 140° C. for about 30 minutes. The thus obtained mixture was cooled to room temperature, pulverized and classified, whereby a toner with a particle diameter of 5 to 20 μm according to the present invention was obtained:

| | Parts by Weight |
|---|---|
| Polyester resin A | 80 |
| Styrene - acryl-based polymer component B | 20 |
| Carbon black | 10 |
| Fluorine-containing quaternary ammonium salt No. II-2 | 2 |
| Metal-containing monoazo dye (Trademark: "Bontron S-34", made by Orient Chemical Industries, Ltd.) | 1 |
| Carnauba wax (Trademark: "Carnauba wax No. 1", made by Noda Wax Co., Ltd.) | 5 |

2.5 parts by weight of the above prepared toner and 97.5 parts by weight of the silicone-resin-coated carrier D were mixed in a ball mill, whereby a two-component type developer was fabricated.

The thus fabricated developer was subjected to the same image formation test as in Example 1. The image quality obtained by the image formation test, and the charge quantity of the toner are shown in Table 2.

Moreover, the grindability, the lower limit temperature for image fixing, the hot off-set occurrence temperature, and the degree of staining of a vinyl chloride sheet with the toner are shown in Table 3.

EXAMPLE 14

The following components were mixed and stirred in a Henschel mixer, and kneaded in a roll mill at 130° to 140° C. for about 30 minutes. The thus obtained mixture was cooled to room temperature, pulverized and classified, whereby a toner with a particle diameter of 5 to 20 μm according to the present invention was obtained:

| | Parts by Weight |
|---|---|
| Polyester resin A | 80 |
| Styrene - acryl-based polymer component B | 20 |
| Carbon black | 10 |
| Fluorine-containing quaternary ammonium salt No. II-2 | 2 |
| Zinc salt of salicylic acid (Trademark: "Bontron E-84", made by Orient Chemical Industries, Ltd.) | 1 |
| Montan wax (Trademark: "WAX-E", made by Hoechst Japan Limited) | 5 |

2.5 parts by weight of the above prepared toner and 97.5 parts by weight of the silicone-resin-coated carrier F were mixed in a ball mill, whereby a two-component type developer was fabricated.

The thus fabricated developer was subjected to the same image formation test as in Example 1. The image quality obtained by the image formation test, and the charge quantity of the toner are shown in Table 2.

Moreover, the grindability, the lower limit temperature for image fixing, the hot off-set occurrence temperature, and the degree of staining of a vinyl chloride sheet with the toner are shown in Table 3.

EXAMPLE 15

The following components were mixed and stirred in a Henschel mixer, and kneaded in a roll mill at 130° to 140° C. for about 30 minutes. The thus obtained mixture was cooled to room temperature, pulverized and classified, whereby a toner with a particle diameter of 5 to 20 μm according to the present invention was obtained:

| | Parts by Weight |
|---|---|
| Polyester resin A | 80 |
| Styrene - acryl-based polymer component resin B | 20 |
| Carbon black | 10 |
| Fluorine-containing quaternary ammonium salt No. II-3 | 2 |
| Zinc salt of salicylic acid (Trademark: "Bontron E-84", made by Orient Chemical Industries, Ltd) | 1 |
| Carnauba wax free of free aliphatic acids (Trademark: "NX-A-03", made by Noda Wax Co., Ltd.) | 5 |

2.5 parts by weight of the above prepared toner and 97.5 parts by weight of the silicone-resin-coated carrier G were mixed in a ball mill, whereby a two-component type developer was fabricated.

The thus fabricated developer was subjected to the same image formation test as in Example 1. The image quality obtained by the image formation test, and the charge quantity of the toner are shown in Table 2.

Moreover, the grindability, the lower limit temperature for image fixing, the hot off-set occurrence temperature, and the degree of staining of a vinyl chloride sheet with the toner are shown in Table 3.

TABLE 2

| | Image Quality | | Charge Quantity (μC/g) | |
|---|---|---|---|---|
| Ex. No. | At initial Stage | After making of continuous copying operation (*) | At initial Stage | After making of continuous copying operation (*) |
| Ex. 8 | Clear Black | Same as left | −18.3 | −16.8 |
| Ex. 9 | Clear Black | Same as left | −19.3 | −17.8 |
| Ex. 10 | Clear Black | Same as left | −17.2 | −15.8 |
| Ex. 11 | Clear Black | Same as left | −20.3 | −18.4 |
| Ex. 12 | Clear Black | Same as left | −17.2 | −16.2 |
| Ex. 13 | Clear Black | Same as left | −20.6 | −20.1 |
| Ex. 14 | Clear Black | Same as left | −21.5 | −20.2 |
| Ex. 15 | Clear Black | Same as left | −23.6 | −21.9 |

Note (*): The continuous copy of 150,000 sheets was performed in Examples 8 to 12. The continuous copy of 200,000 sheets was performed in Examples 13 and 14. The continuous copy of 300,000 sheets was performed in Example 15.

TABLE 3

| Ex. No. | Grindability (kg/h) | Lower Limit Temperature for Image Fixing | Hot Off-set Occurrence Temperature | Degree of Staining of Vinyl Chloride Sheet with Toner |
|---|---|---|---|---|
| Ex. 8 | 3.7 | 137° C. | 240° C. or more | 1 |
| Ex. 9 | 5.1 | 120° C. | 220° C. or more | 2 |
| Ex. 10 | 4.6 | 136° C. | 240° C. or more | 1 |
| Ex. 11 | 4.3 | 134° C. | 240° C. or more | 1 |
| Ex. 12 | 4.5 | 124° C. | 240° C. or more | 1 |
| Ex. 13 | 4.3 | 126° C. | 240° C. or more | 1 |
| Ex. 14 | 4.5 | 129° C. | 240° C. or more | 1 |
| Ex. 15 | 4.4 | 120° C. | 240° C. or more | 1 |

As can be seen from the results in Table 3, the grindability of the toner according to the present invention can be improved in the course of the preparation thereof. The image-fixing performance at low temperature can be achieved, and a vinyl chloride sheet can be prevented from being stained with the toner when the images are formed on an image-receiving sheet by using the toner of the present invention and the vinyl chloride sheet is attached to the toner-image-bearing surface of the above image-receiving sheet.

In addition, the toner of the present invention comprises a charge controlling agent comprising at least one phthalic ester of formula (I) and at least one fluorine-containing quaternary ammonium salt of formula (II), so that high quality toner images which are similar to the initial toner images can be obtained after continuous copying operation. The toner of the present invention can be charged to a negative polarity in a stable condition by the triboelectric charging.

When the charge controlling agent for use in the toner of the present invention further comprises a metal-containing azo dye in addition to the above-mentioned phthalic ester and fluorine-containing quaternary ammonium salt, the negative chargeability of the toner can be further improved.

In addition, the improved releasability is imparted to the toner when the toner comprises a releasing agent such as carnauba wax, montan wax, oxidized rice wax or sazohl wax. As a result, clear images can be obtained.

What is claimed is:

1. A negatively chargeable toner for developing latent electrostatic images comprising:

a coloring agent;

a releasing agent;

a binder resin comprising a polyester and a styrene-acryl-based polymer component at a mixing ratio by weight in the range of (95:5) to (50:50), said styrene-acryl-based polymer component having a weight-average molecular weight of 50,000 to 150,000, a number-average molecular weight of 2,000 to 12,000, and a glass transition temperature of 55° to 70° C.; and a charge controlling agent comprising at least one pthalic ester of general formula (I) which is mixed with said styrene-acryl-based polymer component:

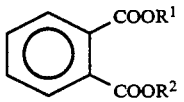

(I)

wherein $R^1$ and $R^2$ each represent a saturated or unsaturated hydrocarbon group having 1 to 20 carbon atoms, a phenyl group, or a phenyl-group-containing saturated or unsaturated hydrocarbon group having 1 to 20 carbon atoms, and at least one fluorine-containing quaternary ammonium salt of general formula (II):

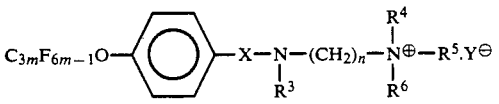

(II)

wherein X represents $—SO_2—$ or —CO—; $R^3$, $R^4$, $R^5$ and $R^6$ each represent hydrogen, an alkyl group having 1 to 10 carbon atoms, or an aryl group; Y represents iodine or bromine; and m and n are integers of 1 to 20.

2. The negatively chargeable toner as claimed in claim 1, wherein said styrene-acryl-based polymer component is a mixture of a styrene homopolymer and an acryl-based homopolymer.

3. The negatively chargeable toner as claimed in claim 2, wherein said mixture of said styrene homopolymer and said acryl-based homopolymer comprises a monomer selected from the group consisting of styrene, substituted monomers thereof, acrylic acid, acrylic acid esters, methacrylic acid, methacrylic acid esters, and acrylonitrile.

4. The negatively chargeable toner as claimed in claim 1, wherein said styrene-acryl-based polymer component is a styrene-acryl-based copolymer.

5. The negatively chargeable toner as claimed in claim 4, wherein said styrene-acryl-based copolymer comprises a monomer selected from the group consisting of styrene, substituted monomers thereof, acrylic acid, acrylic acid esters, methacrylic acid, methacrylic acid esters, and acrylonitrile.

6. The negatively chargeable toner as claimed in claim 1, wherein the amount of said phthalic ester is in the range of 0.1 to 20 wt. % of the total weight of said styrene-acryl-based polymer component.

7. The negatively chargeable toner as claimed in claim 1, wherein the amount of said fluorine-containing quaternary ammonium salt is in the range of 0.1 to 10 wt. % of the total weight of said toner.

8. The negatively chargeable toner as claimed in claim 1, wherein said charge controlling agent further comprises a metal-containing azo dye.

9. The negatively chargeable toner as claimed in claim 1, wherein said releasing agent comprises at least one wax selected from the group consisting of carnauba wax, montan wax, oxidized rice wax and sazohl wax.

10. The negatively chargeable toner as claimed in claim 1, further comprising a magnetic material.

11. The negatively chargeable toner as claimed in claim 10, wherein the amount of magnetic material is in the range of about 20 to 200 parts by weight to 100 parts by weight of said binder resin.

* * * * *